US009724742B2

(12) United States Patent
Stoutamire et al.

(10) Patent No.: US 9,724,742 B2
(45) Date of Patent: Aug. 8, 2017

(54) METHOD OF FORMING FLAT BAR

(71) Applicant: AZZ WSI LLC, Norcross, GA (US)

(72) Inventors: Mark Stoutamire, Cumming, GA (US); Pat Dimaggio, Buford, GA (US); Lewis Fair, Winston, GA (US)

(73) Assignee: AZZ WSI LLC, Norcross, GA (US)

( * ) Notice: Subject to any disclaimer, the term of this patent is extended or adjusted under 35 U.S.C. 154(b) by 0 days.

(21) Appl. No.: 14/453,716

(22) Filed: Aug. 7, 2014

(65) Prior Publication Data

US 2015/0040398 A1 Feb. 12, 2015

Related U.S. Application Data

(60) Provisional application No. 61/863,313, filed on Aug. 7, 2013.

(51) Int. Cl.

| | |
|---|---|
| ***B21D 53/02*** | (2006.01) |
| ***B21C 37/04*** | (2006.01) |
| ***F23M 5/08*** | (2006.01) |
| ***B21D 3/00*** | (2006.01) |
| ***F22B 37/10*** | (2006.01) |
| *B26D 3/11* | (2006.01) |

(52) U.S. Cl.

CPC ..... *B21C 37/04* (2013.01); *B21C 37/042* (2013.01); *B21D 3/00* (2013.01); *B21D 53/027* (2013.01); *F22B 37/10* (2013.01); *F22B 37/108* (2013.01); *F23M 5/08* (2013.01); *B26D 3/11* (2013.01); *Y10T 29/49387* (2015.01); *Y10T 29/49885* (2015.01)

(58) Field of Classification Search

CPC ..... Y10T 29/49885; Y10T 29/49817; Y10T 29/49815; Y10T 29/49822; Y10T 29/49821; Y10T 29/49387; B21D 3/16; B21D 1/10; B21D 53/027; B26D 3/11; F23M 5/08

See application file for complete search history.

(56) References Cited

U.S. PATENT DOCUMENTS 1,567,961 A 12/1925 Lauren
4,045,591 A * 8/1977 Payne ..... E21B 17/006 166/902

(Continued)

FOREIGN PATENT DOCUMENTS

CN 200995508 Y * 12/2007
CN 101576251 A * 11/2009

(Continued)

OTHER PUBLICATIONS

Patent Cooperation Treaty, PCT International Search Report, Issued in Connection with PCT/US2014/050037; Oct. 7, 2014; 3 pages; Europe.

(Continued)

*Primary Examiner* — Jermie Cozart
(74) *Attorney, Agent, or Firm* — Greenberg Traurig LLP

(57) ABSTRACT

A method of forming a flat bar is provided. A tube is provided having an inside surface and an outside surface. The outside surface of the tube can be clad with a nickel or stainless alloy material. A helix shaped strip can be cut from the tube. The helix shaped strip can be uncoiled to form an uncoiled strip, and the uncoiled strip can be straightened and flattened to meet mill standards.

2 Claims, 2 Drawing Sheets

(56) References Cited

U.S. PATENT DOCUMENTS

| | | | | |
|---|---|---|---|---|
| 2002/0069777 | A1* | 6/2002 | Rossini | B41N 1/06<br>101/401.1 |
| 2010/0300379 | A1* | 12/2010 | Itai | F22B 37/102<br>122/235.12 |

FOREIGN PATENT DOCUMENTS

| | | | | |
|---|---|---|---|---|
| GB | 132702 | A | | 9/1919 |
| JP | 53001164 | A | * | 1/1978 |
| JP | 58026996 | A | * | 2/1983 |

OTHER PUBLICATIONS

Patent Cooperation Treaty, PCT Written Opinion of the International Searching Authority, Issued in Connection with PCT/US2014/050037; Oct. 7, 2014; 5 pages; Europe.

* cited by examiner

METHOD OF FORMING FLAT BAR

CROSS REFERENCE TO RELATED APPLICATIONS

This application claims the benefit and priority benefit of U.S. Provisional Patent Application Ser. No. 61/863,313, filed Aug. 7, 2013, titled "Flat Bar and Method of Making Same," the disclosure of which is incorporated herein in its entirety.

BACKGROUND

Field of Invention

This invention relates generally to flat bars used in applications such as waterwall panels for boilers, and more specifically, to an improved flat bar and method of making the same.

Description of the Related Art

It is known in the art to use waterwall panels in boilers. The waterwall panel captures heat from the boiler and uses it to convert water to steam. A waterwall panel is typically comprised of a plurality of evenly spaced tubes that are connected by membrane bars which are typically flat bars made of high temperature carbon steel material. In subsequent operations, a protective layer of high temperature corrosion-erosion resistant alloy is applied to the fireside of the waterwall panel to protect it from the combustion gases and fly ash. Improvements to these existing waterfall panels and methods of making the same are desired. Improvements are also desired to the flat bars used in the waterwall panels and methods of making the same.

SUMMARY

The following presents a simplified summary of the disclosed subject matter in order to provide a basic understanding of some aspects of the subject matter. This summary is not an exhaustive overview of the technology disclosed herein.

In certain illustrative embodiments, an improved method of forming a flat bar is provided. A tube is provided having an inside surface and an outside surface. The outside surface of the tube can be clad with a nickel or stainless alloy material. A helix shaped strip can be cut from the tube. The helix shaped strip can be uncoiled to form an uncoiled strip, and the uncoiled strip can be straightened and flattened to meet mill standards.

In another illustrative embodiment, an improved method of forming a flat bar is provided wherein the tube has an inside surface and an outside surface and is formed from a wrought material. A helix shaped strip can be cut from the tube. The helix shaped strip can be uncoiled to form an uncoiled strip, and the uncoiled strip can be straightened and flattened to meet mill standards.

In another illustrative embodiment, an improved method of forming a flat bar is provided wherein the tube has an inside surface and an outside surface and is formed from a co-extruded material. A helix shaped strip can be cut from the tube. The helix shaped strip can be uncoiled to form an uncoiled strip, and the uncoiled strip can be straightened and flattened to meet mill standards.

In certain illustrative embodiments, an improved method of forming the membrane bar of a waterwall panel for a boiler is provided. A tube is provided having an inside surface and an outside surface. The outside surface of the tube can be clad with a nickel or stainless alloy material. A helix shaped strip can be cut from the tube. The helix shaped strip can be uncoiled to form an uncoiled strip, and the uncoiled strip can be straightened and flattened to meet mill standards. The straightened and flattened strip can then be disposed between a pair of cooling tubes to form the waterwall panel.

In another illustrative embodiment, an improved method of forming the membrane bar of a waterwall panel for a boiler is provided wherein the tube has an inside surface and an outside surface and is formed from a wrought material. A helix shaped strip can be cut from the tube. The helix shaped strip can be uncoiled to form an uncoiled strip, and the uncoiled strip can be straightened and flattened to meet mill standards. The straightened and flattened strip can then be disposed between a pair of cooling tubes to form the waterwall panel.

In another illustrative embodiment, an improved method of forming the membrane bar of a waterwall panel for a boiler is provided wherein the tube has an inside surface and an outside surface and is formed from a co-extruded material. A helix shaped strip can be cut from the tube. The helix shaped strip can be uncoiled to form an uncoiled strip, and the uncoiled strip can be straightened and flattened to meet mill standards. The straightened and flattened strip can then be disposed between a pair of cooling tubes to form the waterwall panel.

BRIEF DESCRIPTION OF THE DRAWINGS

A better understanding of the presently disclosed subject matter can be obtained when the following detailed description is considered in conjunction with the following drawings, wherein.

Figure 1:
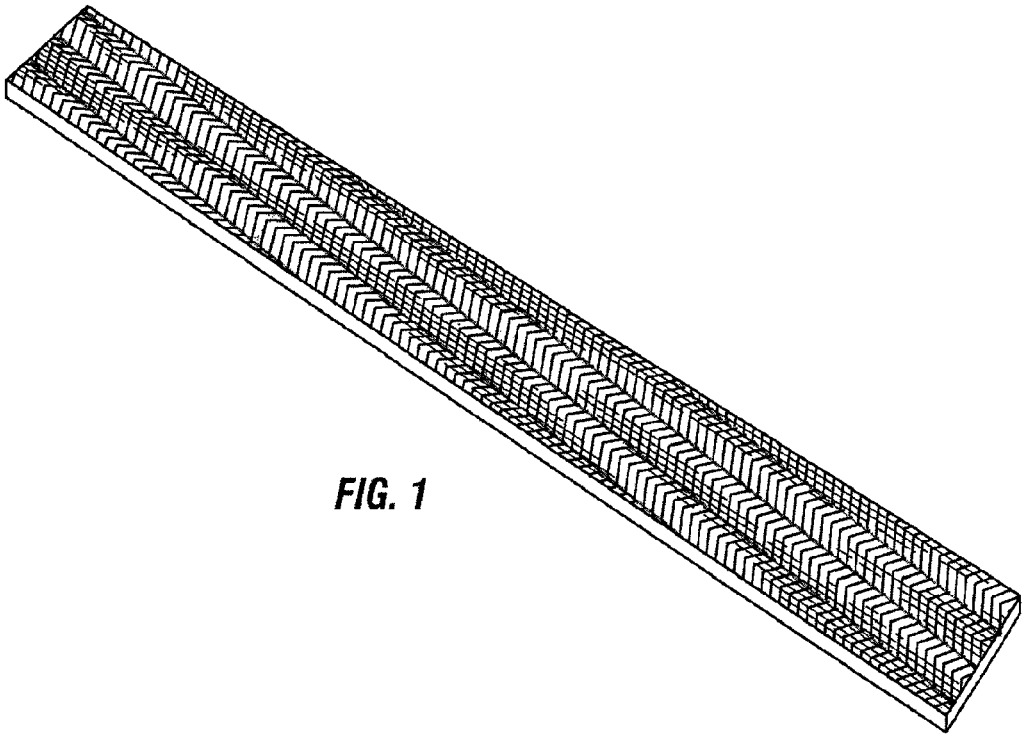
FIG. 1 is a perspective view of a straightened bar in accordance with an illustrative embodiment of the presently disclosed subject matter.

While certain preferred illustrative embodiments will be described herein, it will be understood that this description is not intended to limit the subject matter to those embodiments. On the contrary, it is intended to cover all alternatives, modifications, and equivalents, as may be included within the spirit and scope of the subject matter as defined by the appended claims.

DETAILED DESCRIPTION

The presently disclosed subject matter relates generally to flat bars used in various applications, and more specifically, to an improved flat bar and method of making the same. The flat bar can be used, for example, in waterwall panels for boilers. Thus, the presently disclosed subject matter also relates generally to an improved waterwall panel and method of making the same. The subject matter is described more fully hereinafter with reference to the accompanying drawings in which embodiments of the disclosed subject matter are shown.

Waterwall panels can be fabricated using membrane bars comprising flat bars of carbon steel. The flat bars can be about 0.5 or about 1.0 inches wide and about 0.25 inches thick. The waterwall panels are erected in a vertical fixture in the shop and the membrane bars are then clad on one side using gas metal arc welding ("GMAW"), gas tungsten arc welding ("GTAW") or other techniques. For example, the fireside of the waterwall panel can be coated with a thin layer of a high temperature corrosion-erosion resistant nickel or stainless alloy. The addition of carbon to iron makes steel. Other elements such as chromium (Cr), molybdenum (Mo), and/or nickel (Ni) can be added to the steel in small amounts to further improve the tensile strength and high temperature performance. For instance, 1¼ Cr, 2¼ Cr, and 9 Cr are all alloy steels. Increasing the percentage of chromium from 11-30% can make the steel "stainless", such that it does not rust. Other steels are nickel based and contain very little iron, for instance, Inconel 625. These alloys are designed to provide superior performance against corrosion and erosion in high temperature applications. Alloy steel refers to the high tensile base material, and stainless alloy or nickel alloy refers to the high temperature corrosion erosion resistant coating (cladding).

During welding, the collection of weld beads that is deposited on each membrane bar and at its intersection with the adjacent tubes is generally thicker than the collection of weld beads that cover the outside diameter of the tubes. The beads are over-lapped to improve the as-welded chemistry, and the beads at the intersection of the membrane bar and the tube are thicker due to the corner geometry. This greater thickness is often necessitated by the geometry in the valley of the membrane bar between the adjacent tubes. The increased amount of filler material required for these weld beads results in an excess amount of residual stress and distortion that must be straightened in subsequent manufacturing processes.

In addition, the shrinkage of the weld beads on the membrane bar contributes to an overall reduction in the width of the waterfall panel that is compensated for by using a wider membrane bar in the initial fabrication of the panel. This is extremely difficult to calculate and compensate for in advance.

An alternate process for producing a clad membrane bar includes cladding a large flat plate of carbon steel material and then slitting it into strips prior to constructing the waterwall panel. However, the cladding process excessively distorts the plate. Further, it is expensive to flatten the plate prior to slitting.

In another process, a 360 clad tube can be slit down its length and flattened, and then slit into multiple strips. As used herein, the term "360 clad tube" means the application of a nickel or stainless alloy material to the outside diameter of the tube or pipe in a continuous spiral using a welding process. However, the slitting process is expensive. Also, a wide slit results in an excess of lost material.

If a waterjet is used to slit either the flat plate or flattened tube into strips, the length of the resulting panel is limited to 10 feet. To make a 40 foot continuous panel, as is typically used for waterwall panels, multiple strips are required to be welded end-to-end, which adds to the cost.

In still another process, laser cladding can be used to clad the front side of the panels. Although this process results in less residual stresses, distortion, and shrinkage, the equipment costs and production costs are greater, with the material cost being the largest component of the production cost.

In yet another process, waterwall panels can be fabricated from 360 clad tubes or co-extruded tubes and wrought alloy bars can be used for the membrane bars. However, these panels are more expensive to fabricate and the wrought alloy bars must be purchased in mill run quantities of custom width. Further, having the nickel or stainless alloy material on the backside of the waterwall is not necessary. Therefore, the material cost is double that of panels that are clad only on one side.

The improved flat bar and method of making the same described herein may be embodied in many different forms and should not be construed as limited to the embodiments set forth herein; rather, these embodiments are provided so that this disclosure will be thorough and complete, and will fully convey the scope of the disclosed subject matter to those skilled in the art.

In an illustrative embodiment, a flat bar can be pre-clad with an alloy on a single side during its initial manufacture. The bar can be formed, for example, from a large diameter tube or similar pipe. For example, the tube can have a 0.25 inch thick wall, such as 8 inch SCH 20. In certain illustrative embodiments, the tube can be clad using the Unifuse® 360 process as described in U.S. Patent Application Publication No. 2011/0120977 published May 26, 2011, the disclosure of which is hereby incorporated by reference in its entirety. The alloy can comprise, for example, nickel based or stainless steels. Alternately, the pipe can be clad using laser or metal spray, in other illustrative embodiments.

In another illustrative embodiment, the bar can be formed of a wrought tube or co-extruded tube, whereby cladding is not required. The wrought tube or co-extruded tube can be composed of a nickel or stainless alloy, in certain embodiments. Wrought material is solid, and not coated. In other words, the entire bar is comprised of the nickel or stainless alloy material. Co-extruded material is made by placing a ring of nickel or stainless alloy material around an ingot of carbon steel, then drawing them both simultaneously into the tube or pipe with the nickel or stainless alloy surrounding the carbon steel, in certain illustrative embodiments.

In certain illustrative embodiments, the pre-clad tube can be cut using a tube cutting laser such as, for example, those manufactured by TRUMPF Inc. The tube cutting laser can cut a helix-shaped section from the tube and then sever the section from the tube. The resulting helix-shaped section can resemble a spring or coil. This section can then be put in a custom roll straightening machine and uncoiled and flattened to form the flat bar. Other processes, such as plasma cutting or waterjet, could also be used to helix-cut the tube. By using a pre-clad tube or other wrought or co-extruded tube, the excess material, residual stresses, distortion, and shrinkage in the production process can be minimized.

The desired width of the flat bar to be formed from the tube can be programmed into the tube cutting laser.

For example, a helix formula such as the following can be used:

$$\#\text{ of helix turns} = \frac{L}{\sqrt{(D\pi)^2 + (w)^2}}$$

In the formula provided above, L represents the desired length of the bar, W represents the desired width of the bar, and D represents the diameter of pipe.

For example, if the tube is 8.625 inches in diameter (i.e., 8 inch pipe), then the circumference of the tube is 8.625 inches×Pi, or 27.1 inches. If the desired width of the bar is 1 inch, then the pitch of the helix is 1 inch. If one turn of the helix is uncoiled, straightened and laid flat, the length of the bar will be equal to the hypotenuse of a triangle with both legs equal to the circumference and the pitch, and the square of the hypotenuse is equal to the sum of the squares of the remaining two sides. Thus, if a 40 foot length of bar is desired, then 40 feet equals 480 inches, and 480/(27.12+12) 0.5=480/27.12=17.7 turns (or length of tube).

In certain embodiments, the diameter in the formula is the neutral axis of the tube. When the material is bent, the outside of the bend stretches and the inside compresses. Halfway through the material, at the neutral axis, the length remains the same. The neutral axis of the tube is midway through the thickness of the wall, therefore the diameter of the neutral axis, D, is equal to the outside diameter, OD, minus the wall thickness, T:D=OD−T. This diameter is further modified by the thickness of the overlay, which has a different tensile strength than the tube material. Also, the pitch of the helix is equal to the desired width of the bar plus the width of the material lost in the cut. In practice, a margin for error can be added to the above-indicated formula with respect to the calculated number of turns and the excess can be trimmed.

Figure 2:
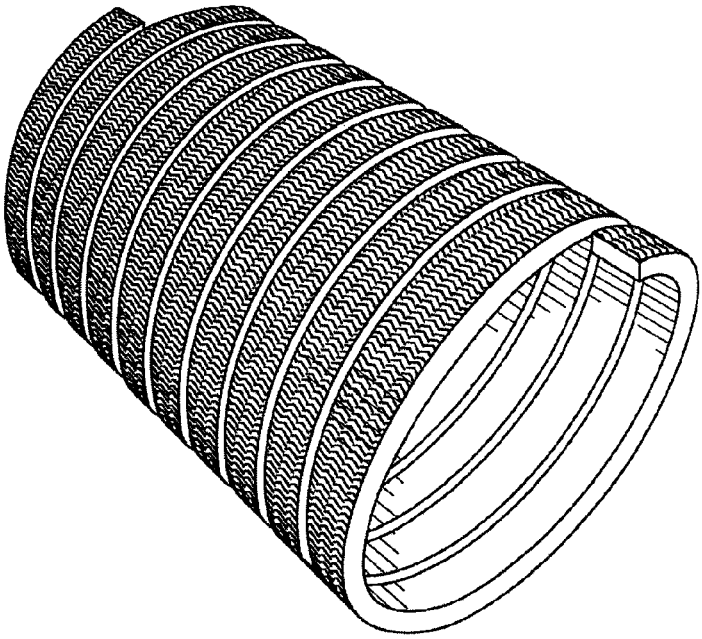
FIG. 2 is a perspective view of a coiled bar in accordance with an illustrative embodiment of the presently disclosed subject matter.
Figure 3:
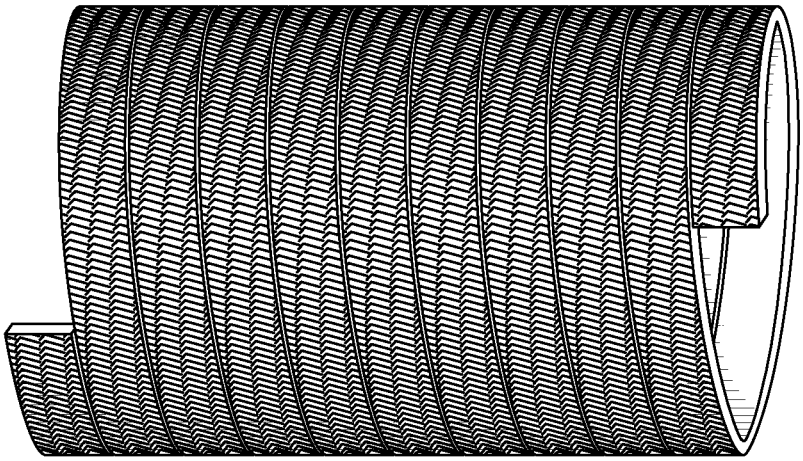
FIG. 3 is a top view of a coiled bar in accordance with an illustrative embodiment of the presently disclosed subject matter.

Various illustrative embodiments of the coiled strip and straightened strip described herein are shown in FIGS. 1-3 hereto. By cutting the tube into a helix shape and then uncoiling and straightening it from its coiled shape and flattening it, it is possible to produce a flat bar of custom width and length, with a minimal cost for straightening and flattening the tube, in certain illustrative embodiments. For example, a line is straight and a plate is flat. A bar is straight along its length (left/right and up/down) and flat across its width (not concave or convex). Also, it cannot twist over its length. In certain illustrative embodiments, straightening and flattening requires the use of reverse bending rollers on both top and bottom and left and right sides of the bar. In certain illustrative embodiments, the bar will be straightened and rolled to mill standards, that is, normal mill tolerance of straight within 1/16" over 5 feet of length, and not exceeding ½" over 40 feet.

In certain illustrative embodiments, the acronym "SPI-ROL" can be used to generally describe the way the pipe is cut and formed to form the flat bar. For example, "SP" or "SLIT PIPE" can refer to the method of creating the bar by cladding (over laying) on the outside and then cutting ("SLIT"), as opposed to other methods that would include cladding plate, then slitting into bars ("SLIT PLATE"), for instance. Since the pipe is clad on the outside, it can be "IR" or "INVERSE ROLLED" to make a flat bar. The pipe can be "OL" or "OVER LAYED" or clad using the GMAW welding process in certain illustrative embodiments, as opposed to being co-extruded with an alloy layer on the outside or clad using a powder or wire in combination with a laser to fuse the alloy to the substrate carbon steel pipe.

In certain illustrative embodiments, any form of pipe coated on one side with an alloy material (for example, GMAW over-layed, GTAW over-layed, laser clad, co-extruded, flame sprayed, etc. . . . ) can be cut into a helix shape using laser, waterjet, or other mechanical methods, and then inverse rolled to create a flat bar.

The alloy-coated flat bar can be used in a variety of applications. For example, in certain illustrative embodiments, the flat bar can be used as a membrane bar in a waterwall panel. The straightened and flattened strip can be disposed between a pair of cooling tubes to form the waterwall panel. The overall shop cycle time to clad the waterwall panel can be reduced due to the elimination of the weld beads required to clad each membrane bar at adjacent membrane-to-tube welds. As a result, the overall manufacturing cost is reduced and a more dimensionally accurate clad waterwall panel can be provided.

It is to be understood that the described subject matter is not limited to the exact details of construction, operation, exact materials, or illustrative embodiments shown and described, as modifications and equivalents will be apparent to one skilled in the art. Accordingly, the subject matter is therefore to be limited only by the scope of the appended claims.

What is claimed is:

1. A method of forming a flat bar, the method comprising:

providing a tube having an inside surface and an outside surface;

cladding the outside surface of the tube with an nickel or stainless alloy material, wherein the cladding results in an increase in the hardness of the tube;

after cladding, cutting a helix shaped strip from the tube;

uncoiling the helix shaped strip to form an uncoiled strip; and straightening and flattening the uncoiled strip.

2. A method of forming a waterwall panel for a boiler, the method comprising:

providing a tube having an inside surface and an outside surface;

cladding the outside surface of the tube with an nickel or stainless alloy material, wherein the cladding results in an increase in the hardness of the tube;

after cladding, cutting a helix shaped strip from the tube;

uncoiling the helix shaped strip to form an uncoiled strip;

straightening and flattening the uncoiled strip; and disposing the uncoiled strip between a pair of cooling tubes to form the waterwall panel.

* * * * *